US009986789B2

(12) United States Patent
Blackman et al.

(10) Patent No.: US 9,986,789 B2
(45) Date of Patent: Jun. 5, 2018

(54) STRAP-SECURING DEVICE WITH INTEGRAL FIRE STARTER

(71) Applicant: ILLINOIS TOOL WORKS INC., Glenview, IL (US)

(72) Inventors: Nicholas C. Blackman, Houston, TX (US); Dustin W. Hogard, Kemah, TX (US)

(73) Assignee: Illinois Tool Works Inc., Glenview, IL (US)

( * ) Notice: Subject to any disclaimer, the term of this patent is extended or adjusted under 35 U.S.C. 154(b) by 196 days.

(21) Appl. No.: 14/764,739

(22) PCT Filed: Feb. 5, 2014

(86) PCT No.: PCT/US2014/014883

§ 371 (c)(1),
(2) Date: Jul. 30, 2015

(87) PCT Pub. No.: WO2014/124016

PCT Pub. Date: Aug. 14, 2014

(65) Prior Publication Data

US 2015/0366298 A1 Dec. 24, 2015

Related U.S. Application Data

(60) Provisional application No. 61/761,413, filed on Feb. 6, 2013.

(51) Int. Cl.

| | |
|---|---|
| ***F23Q 1/06*** | (2006.01) |
| ***A44B 11/00*** | (2006.01) |
| ***A44B 11/25*** | (2006.01) |

(52) U.S. Cl.
CPC ..... *A44B 11/005* (2013.01); *A44B 11/2592* (2013.01); *F23Q 1/06* (2013.01); *Y10T 24/4098* (2015.01)

(58) Field of Classification Search
USPC ..... 431/6; 24/615, 163 K
See application file for complete search history.

(56) References Cited

U.S. PATENT DOCUMENTS 995,463 A 6/1911 Hubert
1,568,022 A * 12/1925 Landrum ..... A44B 11/005 206/101

(Continued)

FOREIGN PATENT DOCUMENTS

GB 2195753 A 4/1988
JP 3020207 U 1/1996

(Continued)

OTHER PUBLICATIONS

ISR and WO for PCT/US2014/014883 dated Jul. 24, 2014, 12 pages.

*Primary Examiner* — Avinash Savani
(74) *Attorney, Agent, or Firm* — Joseph M. Butscher; The Small Patent Law Group, LLC

(57) ABSTRACT

A strap-securing device is configured to be able to be used to ignite a fire. The strap-securing device may include at least one strap-retaining body configured to retain at least one strap, and at least one fire-starting component configured to be used to ignite a fire. For example, the at least one strap-retaining body may include a first buckle member, and a second buckle member configured to be removably connected to the first buckle member. Alternatively, the at least one strap-retaining body may include a slider, cord lock, shackle, and/or the like.

28 Claims, 3 Drawing Sheets

(56) References Cited

U.S. PATENT DOCUMENTS

| | | | | |
|---|---|---|---|---|
| 3,021,986 | A | 2/1962 | Saladino | |
| 4,753,377 | A | 6/1988 | Poluhowich | |
| 5,279,628 | A | 1/1994 | Hutchens et al. | |
| 6,668,428 | B2 | 12/2003 | Imoeller | |
| 7,296,327 | B2 | 11/2007 | Anderson et al. | |
| 7,302,742 | B2 | 12/2007 | Pontaoe | |
| 7,331,088 | B2 | 2/2008 | Pontaoe | |
| 2002/0029440 | A1* | 3/2002 | Moeller | A44B 11/001 24/163 R |
| 2007/0089280 | A1 | 4/2007 | Pontaoe | |
| 2008/0078069 | A1 | 4/2008 | Pontaoe | |
| 2008/0222860 | A1 | 9/2008 | Pontaoe | |
| 2010/0115736 | A1 | 5/2010 | Paik | |
| 2013/0189631 | A1* | 7/2013 | Mojica | F23Q 1/06 431/274 |
| 2013/0224667 | A1 | 8/2013 | Roybal | |

FOREIGN PATENT DOCUMENTS

| | | | |
|---|---|---|---|
| WO | 2009003900 | A1 | 1/2009 |
| WO | 2012162615 | A2 | 11/2012 |

* cited by examiner

STRAP-SECURING DEVICE WITH INTEGRAL FIRE STARTER

RELATED APPLICATIONS

This application is a National Phase of PCT/US2014/014883 filed Feb. 5, 2014, and relates to and claims priority benefits from U.S. Provisional Patent Application No. 61/761,413 filed Feb. 6, 2013, which is hereby incorporated by reference in its entirety.

FIELD OF THE DISCLOSURE

Embodiments of the present disclosure generally relate to strap-securing devices, such as buckles, sliders, cord locks, shackles, and the like, and more particularly to strap-securing devices that include an integral fire starter.

BACKGROUND OF THE DISCLOSURE

Various devices are used to secure and tend straps, such as webs, webbing, ropes, strings, belts, cords, and the like. For example, a typical belt includes a buckle. Various other strap-securing devices with similar functions encompass a wide range of designs and related functions. The devices are generally intended to encompass various functions, such as securing straps under tension (for example, a buckle or webbing adjuster), confining straps to a particular area (for example, a slider), limiting movement of other items along a strap (for example, a cord lock), and the like. Articles utilizing such devices are ubiquitous where one finds hikers, boaters, campers, climbers, and other persons employing similar gear.

In various settings, an individual may desire to make a fire for warmth, light, cooking, purifying water, and/or the like. Often, the need for fire is unexpected, such as when an individual is lost or stranded. However, individuals often neglect to equip themselves with a fire starter. Moreover, even if an individual remembers to pack a fire starter, he/she may lose the fire starter, or the fire starter may not properly function. For example, a lighter may be depleted of fuel and may not be able to generate a flame.

Various types of fire starters are known. A typical fire starter includes a device that is used to generate a spark that is used in conjunction with a fuel to start a flame. For example, U.S. Pat. No. 5,279,628 and U.S. Pat. No. 995,463 describe known fire starting devices. In general, during an emergency, fire may be needed for survival. Because instances of such an emergency may be relatively rare, however, individuals often neglect to pack a fire starter, due, at least in part, to the probability of an emergency occurring, and/or limited packing space. For example, an individual may decide against filling limited space within a backpack with one or more fire starters when the limited space may be better served, at least in the mind of that particular individual, with various other items. Accordingly, it is understandable that many individuals simply forget to carry (or opt against carrying) a fire starter due to its limited and infrequent need.

Nevertheless, when an emergency occurs, an individual may regret the decision not to pack a fire starter.

SUMMARY OF THE DISCLOSURE

Certain embodiments of the present disclosure provide a strap-securing device configured to be able to be used to ignite a fire. The strap-securing device may include at least one strap-retaining body configured to retain at least one strap, and at least one fire-starting component configured to be used to ignite a fire. In at least one embodiment, the fire-starting component(s) may be integrally formed with the strap-retaining bod(ies).

In at least one embodiment, the at least one strap-retaining body may include a first buckle member, and a second buckle member configured to be removably connected to the first buckle member. The at least one fire-starting component may include a striker secured to one of the first or second buckle members, and at least one striker-engaging beam secured to at least one of the first or second buckle members. The striker is configured to be swiped, scraped, or the like across the striker-engaging beam(s) to generate a spark to ignite the fire. In at least one embodiment, the striker-engaging beam(s) provides at least one strap bar for one or both of the first and second buckle members. In at least one embodiment, the at least one striker-engaging beam provides a guide beam configured to guide connection between the first and second buckle members. The striker may be moveably secured within a sheath of the first or second buckle member.

At least one strap-retaining body may include a compartment defining an internal chamber. The fire-starting component(s) may be stored in the internal chamber. A door, such as a sliding or hinged door, may cover the compartment in a closed position.

In at least one embodiment, the at least one strap-retaining body includes a slider. The at least one fire-starting component includes at least one striker-engaging beam. In at least one embodiment, the at least one striker-engaging beam is removably clipped to the strap-retaining body. In at least one embodiment, the at least one striker-engaging beam provides at least one strap beam of the slider. Additionally, or alternatively, the at least one strap-retaining body may include a cord lock, shackle, or the like.

Certain embodiments of the present disclosure provide a strapped article configured to be used by an individual. The strapped article may include a main body of material, a plurality of straps connected to the main body of material, and a plurality of strap-securing devices moveably secured to the plurality of straps. Each of the plurality of strap securing device may be configured to be able to be used to ignite a fire. The main body of material may include a pack to be worn on a back of the individual.

Certain embodiments of the present disclosure provide a strap-securing device that may include at least one strap-retaining body configured to retain at least one strap, at least one fire-starting component configured to be used to ignite a fire, and a whistle. For example, the at least one fire-starting component and the whistle may form portions of the at least one-strap-retaining body.

Figure 1:
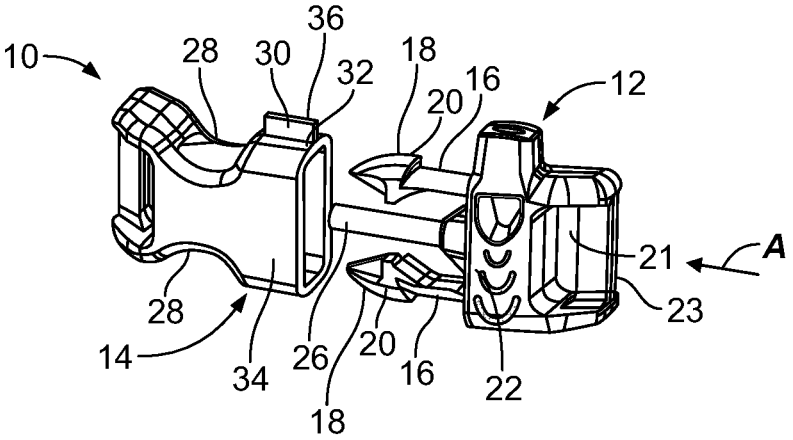
FIG. 1 illustrates a perspective front view of a strap-securing device in a disconnected state, according to an embodiment of the present disclosure.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE DISCLOSURE

FIG. 1 illustrates a perspective front view of a strap-securing device 10 in a disconnected state, according to an embodiment of the present disclosure. As shown in FIG. 1, the strap-securing device 10 may be a buckle assembly that includes one or more strap-retaining bodies, such as a first or male connection member 12 and a cooperating second or female connection member 14. The male connection member 12 may include a pair of flexible lateral arms 16 having buttons 18 at distal ends 20. A main body 22 extends between the lateral arms 16. A strap-receiving channel 21 is formed through the male connection member 12 between the main body 22 and a strap bar 23, which is configured to clamp into and/or slidably retain a strap. The lateral arms 16 are configured to inwardly pivot about pivot points defined by the union of the main body 22 and the lateral arms 16.

In order to secure the male connection member 12 into the female connection member 14, the male connection member 12 is urged into the female connection member 14 in the direction of arrow A. A fire-starting component, such as a striker-engaging beam 26 (which may also act as a guide beam), of the male connection member 12 may move into a reciprocal channel (not shown) formed in the female connection member 14 to ensure proper mating alignment between the male and female connection members 12 and 14, respectively. Optionally, the female connection member 14 may not include a reciprocal channel. Instead, the striker-engaging beam 26 may simply be a fire-starting component and may not also function as a guide beam.

As the male connection member 12 is urged into the female connection member 14, the lateral arms 16 deflect inwardly in the directions until the buttons 18 reach button openings 28 formed through the female connection member 14. When the buttons 18 enter the button openings 28, the tension stored in the lateral arms 16 snapably forces the lateral arms 16 and the buttons laterally outward, so that the buttons 18 are secured within the button openings 28. At this point, the male connection member 12 is secured to the female connection member 14.

Figure 2A:
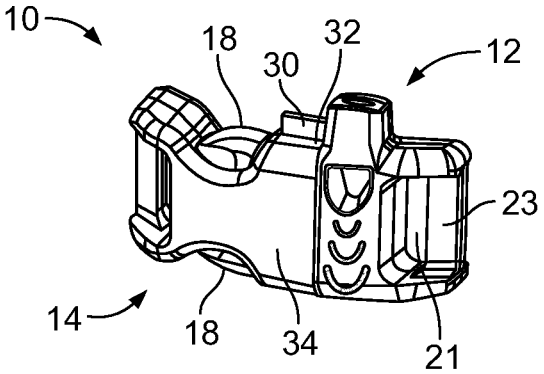
FIG. 2A illustrates a perspective front view of a strap-securing device in a connected state, according to an embodiment of the present disclosure.

FIG. 2A illustrates a perspective front view of the strap-securing device 10 in a connected state. In order to disconnect the male connection member 12 from the female connection member 14, the buttons 18 are squeezed toward one another.

Referring to FIGS. 1 and 2A, a fire-starting component, such as a striker 30, may outwardly extend from a surface of the female connection member 14. For example, the striker 30 may perpendicularly extend from a lateral surface 32 of a shroud 34 of the female connection member 14. Alternatively, the striker 30 may outwardly extend from various other surfaces of the shroud 34. For example, the striker 30 may outwardly extend from a front, rear, lower, or upper surface of the shroud. In order to start a fire, the female connection member 14 may be disconnected from the male connection 12 member and the striker 30 may be swiped, scraped, or the like across a length of the striker-engaging beam 26 to generate a spark.

The striker-engaging beam 26 may be integrally formed with the male connection member 12. As shown, the striker-engaging beam 26 may outwardly extend from the main body 22 between the lateral arms 16. The striker-engaging beam 26 may be a rod, plate, board, tab, stud, column, protuberance, and/or the like of varying shapes and sizes. The striker-engaging beam 26 may be a friction-based fire starting component formed of a material such as Ferrocerium. Alternatively, the striker-engaging beam 26 may be formed of various other pyrophoric materials, such as fire steels, flint rods, fire strikers, and/or the like.

The striker-engaging beam 26 may be located at various other portions of the male connection member 12 than shown in FIGS. 1 and 2. For example, the striker-engaging beam 26 may be connected to or replace the strap bar 23. As such, the striker-engaging beam 26 may also serve to engage a strap, such as a webbing, web, belt, cord, rope, string, and/or the like. Also, alternatively, the striker-engaging beam 26 may be positioned on the female connection member 14, while the striker 30 is positioned on the male connection member 12.

As noted above, the striker 30 may outwardly extend from the female connection member 14. The striker 30 may be or otherwise include a hard, crisp-edged protuberance 36, such as a plate, tab, or the like, which may be formed of a material such as metal, ceramic, or the like that is used to scrape the striker-engaging beam 26 to generate a spark, for example.

As shown in FIG. 2A, when the male connection member 12 is connected to the female connection member 14, the shroud 34 of the female connection member 14 covers and protects the striker-engagement beam 26. As such, the striker-engagement beam 26 may be protected against inadvertent touching or engagement by the striker 30, for example.

Figure 2B:
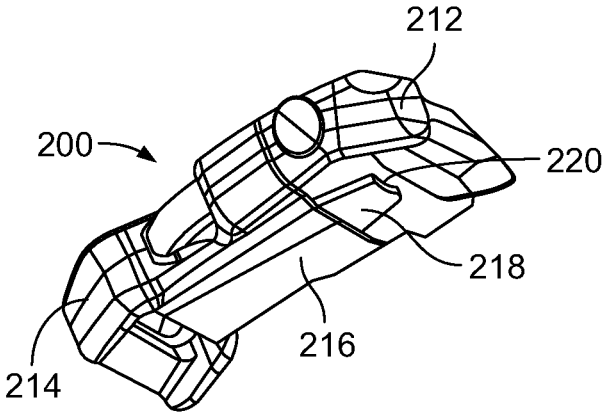
FIG. 2B illustrates a perspective rear view of a strap-securing device in a connected state, according to an embodiment of the present disclosure.

FIG. 2B illustrates a perspective rear view of a strap-securing device 200 in a connected state, according to an embodiment of the present disclosure. The strap-securing device 200 includes a male connection member 212 and a female connection member 214. The female connection member 214 may include a sheath 216 formed on an outer surface, such as a rear surface. Alternatively, the sheath 216 may be on various other surfaces of the female connection member 214. The sheath 216 slidably retains a striker 218. The striker 218 may be slid in and out of the sheath 216. The striker 218 may include a pointed or sharpened edge 220, and may also be configured to serve as a small knife, for example. Alternatively, the sheath 216 and the striker 218 may be on the male connection member 212.

Figure 3:
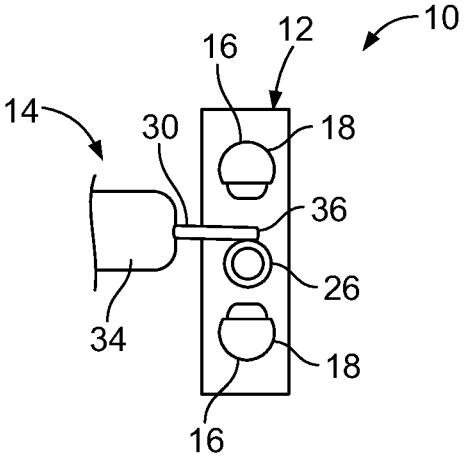
FIG. 3 illustrates an end view of a strap-securing device in a fire-starting orientation, according to an embodiment of the present disclosure.

FIG. 3 illustrates an end view of the strap-securing device 10 in a fire-starting orientation, according to an embodiment of the present disclosure. Referring to FIGS. 1-3, in order to operate the strap-securing device 10 to generate a spark to start a fire, the female connection member 14 is disconnected from the male connection member 12. The female connection member 14 is then oriented so that the main body 36 of the striker 30 abuts against an outer surface of the striker-engaging beam 26. For example, the female connection member 14 may be oriented perpendicular to the male connection member 12 and the protuberance 36 of the striker 30 may be positioned on the striker-engaging beam 26 away from the lateral arms 16 (that is, the main body 36 of the striker 30 may not touch the lateral arms 16). In order to generate a spark to start a fire, the striker 30 is swiped, scraped, or the like along a length of the striker-engaging beam 26 while maintaining contact therewith.

It is to be understood that the orientations shown in FIG. 3 are merely exemplary. Instead of the striker 30 being positioned on the striker-engaging beam 26 underneath a lateral arm 16, as shown in FIG. 3, an edge of a distal tip of the striker 30 may engage an outer lateral surface (as shown in FIG. 3) of the striker-engaging beam 26 without being positioned between the striker-engaging beam 26 and a lateral arm 16. Instead, the striker 30 may abut against the striker-engaging beam 26 such that the striker 30 is perpendicular to a longitudinal axis of the striker-engaging beam 26. The striker 30 may then be swiped, scraped, or the like along the longitudinal axis of the striker-engaging beam 26 to generate a spark. In general, the striker 30 may be positioned with respect to the striker-engaging beam 26 in various orientations, directions, positions, and the like in order to generate a spark.

As such, the strap-securing device 10 may provide a buckle assembly as well as a fire-starter, which may include one or more fire-starting components, such as the striker-engaging beam 26 and the striker 30. FIGS. 1-3 illustrate the strap-securing device 10 as a side release buckle assembly. It is to be understood, however, that embodiments of the present disclosure may be used with various types of buckle assemblies. For example, embodiments of the present disclosure may be used in conjunction with any of the assemblies shown and described in U.S. Pat. No. 6,668,428, entitled "Fasteners Incorporating a Whistle," U.S. Pat. No. 7,331,088, entitled "Buckle Assembly," U.S. Pat. No. 7,296,327, entitled "Buckle Assembly," U.S. Pat. No. 7,302,742, entitled "Side Release Buckle Assembly," PCT Publication WO2012/162615, entitled "Buckle Assembly," United States Patent Application Publication No. 2007/0089280, entitled "Side Release Buckle Assembly," and United States Patent Application Publication No. 2008/0222860, entitled "Buckle Assembly," all of which are hereby incorporated by reference in their entireties. Embodiments of the present disclosure may be used in conjunction with the embodiments shown and described in U.S. Pat. No. 6,668,428, for example, to provide a strap-securing device or fastener that incorporates at least one fire starting component and a whistle.

Figure 4:
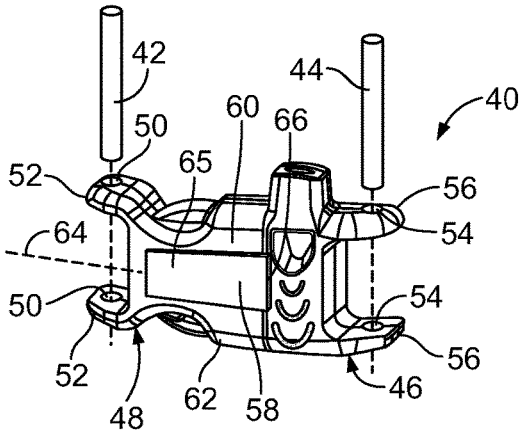
FIG. 4 illustrates a perspective front view of a strap-securing device in a connected state with two striker-engaging beams removed, according to an embodiment of the present disclosure.
Figure 5:
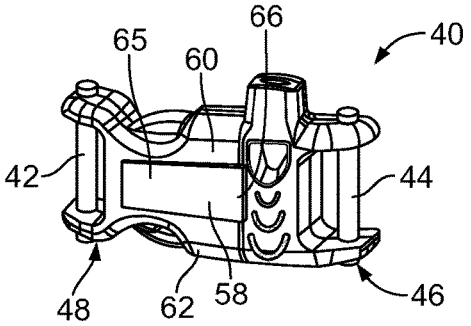
FIG. 5 illustrates a perspective front view of a strap-securing device having striker-engaging beams that also serve as strap bars, according to an embodiment of the present disclosure.

FIG. 4 illustrates a perspective front view of a strap-securing device 40 in a connected state with two striker-engaging beams 42 and 44 removed, according to an embodiment of the present disclosure. FIG. 5 illustrates a perspective front view of the strap-securing device 40 in which the striker-engaging beams 42 and 44 also serve as strap bars, according to an embodiment of the present disclosure.

Referring to FIGS. 4 and 5, the strap-securing device 40 is similar to the strap-securing device 10 shown in FIGS. 1-3, except that the striker-engaging beam 42 may be inserted into opposed openings 50 of opposed bar prongs 52 of a female connection member 48, while the striker-engaging beam 44 may be inserted into opposed openings 54 of opposed bar prongs 56 of a male connection member 46. For example, the striker-engaging beams 42 and 44 may be secured into the openings 50 and 54, respectively, through an interference fit, threadable connection, compression connection, and/or the like. As an example, terminal ends of each of the striker-engaging beams 42 and 44 may include outer threadable interfaces that engage internal threadable interfaces of the openings 50 and 54, respectively.

Alternatively, instead of openings 50 and 54 formed through the bar prongs 52 and 56, respectively, the bar prongs 52 and 56 may include internal recessed areas that are configured to receive and retain ends of the striker-engaging beams 42 and 44, respectively. In order to secure the striker-engaging beams 42 and 44 into the bar prongs 52 and 56, respectively, the opposed bar prongs 52 and 56 may be spread open so that the striker-engaging beams 42 and 44 fit therebetween. Once the ends of the striker-engaging beams 42 and 44 are aligned with the reciprocal recessed areas, the spreading force is released, thereby allowing the opposed bar prongs 52 or 56 to snap back to their at-rest positions and secure the striker-engaging beams 42 or 44 therebetween.

As shown, the strap-securing device 40 includes the two striker-engaging beams 42 and 44. As such, a backup striker-engaging beam 42 or 44 may be used in case one of the striker-engaging beams 42 or 44 is inoperable, such as if too much material has been scraped therefrom. Additionally, the striker-engaging beams 42 and 44 may be used in place of the strap bars shown in FIGS. 1 and 2. Accordingly, one or more embodiments of the present disclosure may include three or more striker-engaging beams. Also, alternatively, the strap-securing device 40 may include only one of the striker-engaging beams 42 or 44.

The female connection member 48 includes a striker 58 that may extend over at least a portion of a front surface 60 of a shroud 62. The striker 58 may be aligned with a longitudinal axis 64 of the strap-securing device 40 and may include a flat sheet 65 that longitudinally extends over the front surface 60. A contact edge 66 may extend past a distal edge of the shroud 62. The contact edge 66 may be used to contact the striker-engaging beams 42 or 44, similar to as described above with respect to FIG. 3.

Alternatively, the male connection member 46 may include the striker. Also, alternatively, both the male connection member 46 and the female connection member 48 may include separate strikers.

Figure 6:
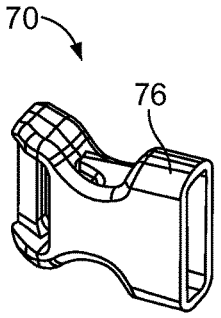
FIG. 6 illustrates a perspective front view of a disconnected strap-securing device having a fire-starting device contained within a compartment, according to an embodiment of the present disclosure.
Figure 6:
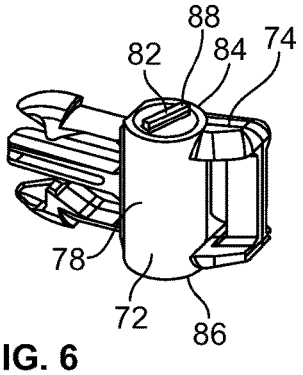

FIG. 6 illustrates a perspective front view of a disconnected strap-securing device 70 having one or more fire-starting components contained within a compartment 72, according to an embodiment of the present disclosure. The compartment 72 may be integrally formed with a male connection member 74. Alternatively, the compartment 72 may be integrally formed with a female connection member 76.

The compartment 72 may include a main housing 78 defining an internal chamber 80 (shown in FIG. 7). The main housing 78 may be cylindrical, as shown. Alternatively, the main housing 78 may be various other shapes and sizes. A covering cap 82 is removably secured to an end 84 of the main housing 78. The opposite end 86 of the main housing 78 may be a fixed closed end. Optionally, both ends 84 and 86 may be fit with a removable covering cap 82, which may provide a sealing engagement with the compartment 72 to provide a fluid tight internal chamber 80.

The covering cap 82 may be removably secured to the end 84 through various types of interfaces. For example, the covering cap 82 may be threadably secured to the end 84. Alternatively, the covering cap 82 may be frictionally secured to the end, such as through an interference fit. The covering cap 82 may include a tactile handle 88, such as a tab, ridge, or the like, that may be grasped by an individual to remove the covering cap 82. In at least one embodiment, the tactile handle 88 may be grasped and rotated to remove the covering cap 82 from the main housing 78.

Figure 7A:
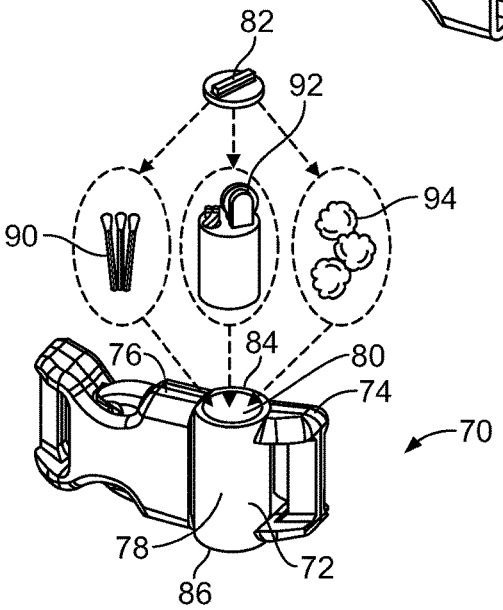
FIG. 7A illustrates a perspective front view of a connected strap-securing device in which one or more fire-starting devices may be contained within a compartment, according to an embodiment of the present disclosure.

FIG. 7A illustrates a perspective front view of the connected strap-securing device 70 in which one or more fire-starting components 90, 92, and 94 may be contained within the compartment 72, according to an embodiment of the present disclosure. The cover 82 may be removed from the compartment 72 to expose the internal chamber 80. Various fire-starting components 90, 92, and 94 may then be stored within the internal chamber 80. For example, the fire starting components may include matches 90, a lighter 92, and/or fuels 94, such as natural combustible fibers that may or may not be mixed with other fire aiding agents. The compartment 72 shown in FIGS. 6 and 7 may be used with any of the embodiments described in the present application, such as those shown in FIGS. 1-5. For example, the male connection member 12 shown in FIGS. 1-3 may also include the compartment 72.

Figure 7B:
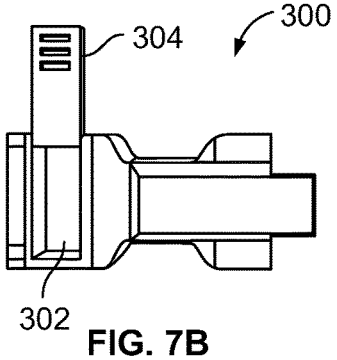
FIG. 7B illustrates a front view of a connection member having a compartment, according to an embodiment of the present disclosure.

FIG. 7B illustrates a front view of a connection member 300 having a compartment 302, according to an embodiment of the present disclosure. As shown, the compartment 302 may be formed within a female connection member. Alternatively, the compartment 302 may be part of a male connection member. The compartment 302 may be a formed recess, cavity, chamber, or the like within the connection member 300. A sliding door 304 may be slidably positioned over the compartment 302. The sliding door 304 is configured to be moved between an open position (as shown in FIG. 7B), and a closed position. Alternatively, instead of a sliding door, the compartment 302 may be selectively covered and opened through a hinged door, for example.

Figure 8:
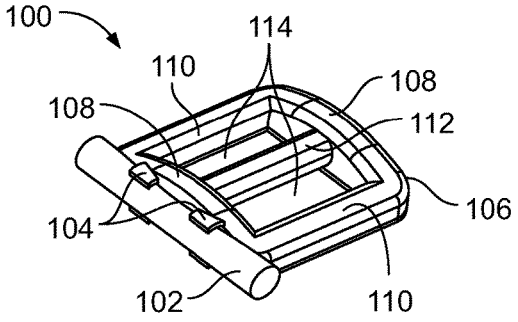
FIG. 8 illustrates a perspective top view of a strap-securing device having a striker-engaging beam, according to an embodiment of the present disclosure.

FIG. 8 illustrates a perspective top view of a strap-securing device 100 having a striker-engaging beam 102, according to an embodiment of the present disclosure. The strap-securing device 100 may be a slider, for example. The striker-engaging beam 102 may be frictionally secured to retaining clips 104 that outwardly extend from a strap-retaining body 106 of the strap-securing device 100. The strap-retaining body 106 also includes lateral walls 108 integrally connected to end strap beams 110 and a middle strap beam 112. Strap channels 114 are defined between each of the end strap beams 110 and the middle strap beam 112. The strap-securing device 100 may be used to adjust a length of a strap, for example. The strap-securing device 100 may take the form of various sliders other than shown in FIG. 8. For example, the strap-securing device 100 may be similar to the embodiments shown in United States Patent Application Publication No. 2008/0078069, entitled "Strap Adjusting Assembly," which is hereby incorporated by reference in its entirety. Alternatively, one or more of the strap beams 110 and 112 may be replaced with a striker-engaging beam 102.

Figure 9:
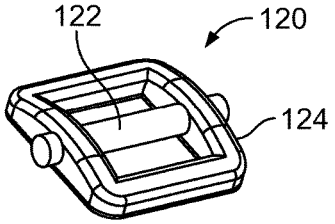
FIG. 9 illustrates a perspective top view of a strap-securing device having a striker-engaging beam that also acts as a strap bar, according to an embodiment of the present disclosure.
Figure 10:
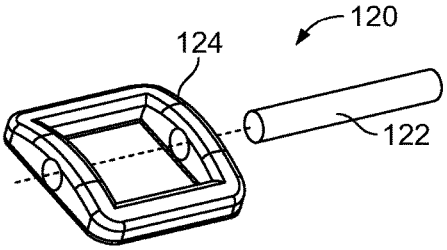
FIG. 10 illustrates a perspective top view of a strap-securing device with a striker-engaging beam removed from a main body, according to an embodiment of the present disclosure.

FIG. 9 illustrates a perspective top view of a strap-securing device 120 having a striker-engaging beam 122 that also acts as a strap bar, according to an embodiment of the present disclosure. FIG. 10 illustrates a perspective top view of the strap-securing device 120 with the striker-engaging beam 122 removed from a main body 124, according to an embodiment of the present disclosure. Referring to FIGS. 9 and 10, the striker-engaging beam 122 may be removably secured to the main body 124, such as described above with respect to FIGS. 4 and 5. While shown as the middle strap beam, the striker-engaging beam 122 may replace any of the strap beams of the main body 124. Also, alternatively, two or more of multiple striker-engaging beams 122 may be used in place of the strap beams. For example, each of the three strap beams shown in FIG. 8, for example, may be replaced with a striker-engaging beam 122.

Figure 11:
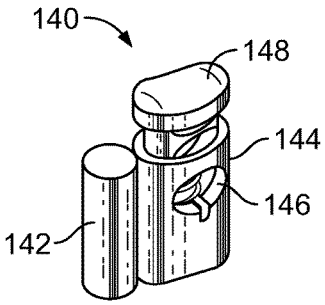
FIG. 11 illustrates a perspective front view of a strap-securing device having a striker-engaging beam, according to an embodiment of the present disclosure.

FIG. 11 illustrates a perspective front view of a strap-securing device 140 having a striker-engaging beam 142, according to an embodiment of the present disclosure. The strap-securing device 140 may be a cord lock having a strap-retaining body, such as a main housing 144. A cord hole 146 is formed through the main housing 144. Tension in a cord passing through the cord hole 146 may be adjusted by depressing a button 148 also having a hole that aligns with the cord 146 when depressed. When pressure is released from the button 148, the cord is bound by friction between the main housing 144 and the button 148.

The striker-engaging beam 142 may be longitudinally aligned with the main housing 144 and extends outwardly therefrom. For example, the striker-engaging beam 142 may be permanently secured to the main housing 144, and/or removably secured thereto through clips, such as the clips 104 shown in FIG. 8. Alternatively, at least a portion of the main housing 142 may be a striker-engaging beam 142.

Figure 12:
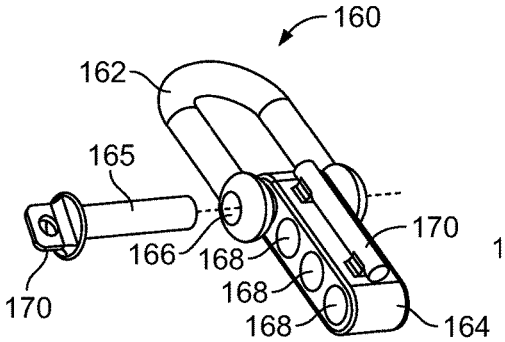
FIG. 12 illustrates a perspective top view of a strap-securing device, according to an embodiment of the present disclosure.

FIG. 12 illustrates a perspective top view of a strap-securing device 160, according to an embodiment of the present disclosure. The strap-securing device 160 may be a shackle that may be used in relation to straps, such as cords, webbing, and the like. The strap-securing device 160 includes one or more strap-retaining bodies, such as a U-shaped bar 162 operatively connected to a pivotal tongue 164. A pin 165 is configured to be removably secured into a hole 166 or holes 168 that are configured to allow for length adjustment.

A striker-engaging beam 170 may be secured to the strap-securing device 160, such as described above. For example, the striker-engaging beam 170 may be clipped to the tongue 160. Optionally, the pin 165 may be a striker-engaging beam 170. Additionally, a grasping protuberance 170 of the pin 165 may be formed as a striker, as described above.

Figure 13:
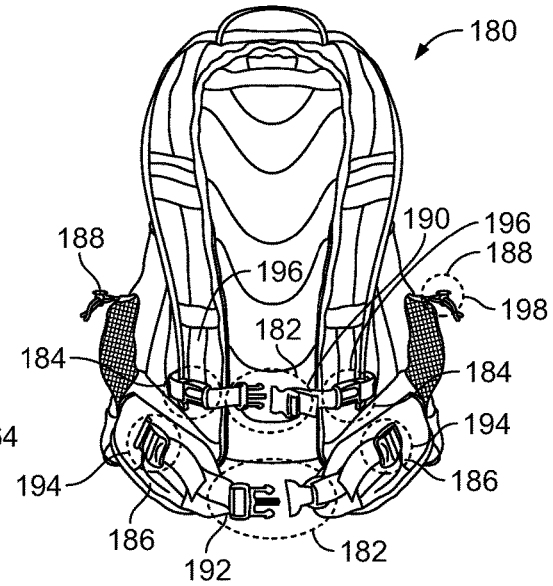
FIG. 13 illustrates a perspective front view of a backpack including a plurality of strap-securing devices, according to an embodiment of the present disclosure.

FIG. 13 illustrates a perspective front view of a backpack 180 including a plurality of strap-securing devices 182, 184, 186, and 188, according to an embodiment of the present disclosure. The strap-securing devices 182 may be buckle assemblies, such as described with respect to FIGS. 1-7. The strap-securing devices 184 may be shackles, such as described with respect to FIG. 12. The strap-securing devices 186 may be sliders, such as described with respect to FIGS. 8-10. The strap-securing devices 188 may be cord locks, such as described with respect to FIG. 11. The backpack 180 may include multiple web-securing members, each of which may include at least one fire-starting component, such as described above. Optionally, less than all of the strap-securing devices 182, 184, 186 and 188 may include at least one fire-starting component. The strap-securing devices 182, 184, 186, and 188 may be located on or otherwise in relation to a sternum strap 190, a hip belt 192, shoulder strap 196, pocket 198, and/or the like. While the backpack 180 is shown in FIG. 13, it is to be understood that embodiments of the present disclosure may be used with various other strapped articles including a main body of material, such as equipment, clothing, and/or the like, such as a jacket, a bracelet, boots, compression straps, harnesses, helmets, gloves, stuff sacks, and the like.

Referring to FIGS. 1-13, embodiments of the present disclosure provide strap-securing devices that include at least one fire-starting component, such as a striker-engaging beam, striker, compartment that contains fire-starting devices, and/or the like. The strap-securing devices may be used with various types of equipment, clothing, and the like. As such, in the event of an emergency, for example, an individual has the ability to start a fire, even if he/she did not think to pack a separate fire starter, such as a lighter.

Embodiments of the present disclosure provide strap-securing devices having integral fire-starting components that may be used with straps, such as webs, webbing, cords, ropes, strings, belts, and the like, of various shapes, sizes. The fire-starting components are generally unobtrusive, yet are quickly and easily accessible. The fire-starting components may be quickly deployed.

The fire-starting components may include various fire-starting materials, such as Ferrocerium rods, lighters, magnesium, matches, piezoelectric igniters, and the like. Examples of solid and liquid fuel ingredients that may be used as, or with, the fire-starting components include alcohol, butane, cotton, natural fiber, wax, petroleum jell, and the like.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the embodiments disclosed and defined herein extend to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure. The claims are to be construed to include alternative embodiments to the extent permitted by the prior art.

To the extent used in the appended claims, the terms "including" and "in which" are used as the plain-English equivalents of the respective terms "comprising" and "wherein." Moreover, to the extent used in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

Various features of the disclosure are set forth in the following claims.

The invention claimed is:

1. A strap-securing device configured to be able to be used to ignite a fire, the strap-securing device comprising:

at least one strap-retaining body configured to retain at least one strap, wherein the at least one strap-retaining body includes a compartment defining an internal chamber, wherein the compartment is configured to store at least one item within the internal chamber; and at least one fire-starting component configured to be used to ignite a fire, wherein the at least one fire-starting component is integrally formed with the at least one strap-retaining body.

2. The strap-securing device of claim 1, wherein the at least one strap-retaining body comprises:

a first buckle member; and a second buckle member configured to be removably connected to the first buckle member.

3. The strap-securing device of claim 2, wherein the at least one fire-starting component comprises:

a striker secured to one of the first or second buckle members; and at least one striker-engaging beam secured to at least one of the first or second buckle members, wherein the striker is configured to be swiped or scraped across the at least one striker-engaging beam to generate a spark to ignite the fire.

4. The strap-securing device of claim 3, wherein the at least one striker-engaging beam provides at least one strap bar for one or both of the first and second buckle members.

5. The strap-securing device of claim 3, wherein the at least one striker-engaging beam provides a guide beam configured to guide connection between the first and second buckle members.

6. The strap-securing device of claim 3, wherein the striker is moveably secured within a sheath on an outer portion of the first or second buckle member, wherein the striker is configured to move in relation to the sheath.

7. The strap-securing device of claim 1, wherein the internal chamber is configured to store at least one additional fire starting component.

8. The strap-securing device of claim 7, further comprising a door that covers the compartment in a closed position.

9. The strap-securing device of claim 1, wherein the at least one strap-retaining body includes a slider.

10. The strap-securing device of claim 9, wherein the at least one fire-starting component includes at least one striker-engaging beam.

11. The strap-securing device of claim 10, wherein the at least one striker-engaging beam is removably clipped to the strap-retaining body.

12. The strap-securing device of claim 10, wherein the at least one striker-engaging beam provides at least one strap beam of the slider.

13. The strap-securing device of claim 1, wherein the at least one strap-retaining body includes a cord lock.

14. The strap-securing device of claim 1, wherein the at least one strap-retaining body includes a shackle.

15. A strapped article configured to be used by an individual, wherein the strapped article comprises:

a main body of material;

a plurality of straps connected to the main body of material; and a plurality of strap-securing devices moveably secured to the plurality of straps, wherein each of the plurality of strap securing device is configured to be able to be used to ignite a fire, wherein each of the strap-securing devices comprises:

at least one strap-retaining body configured to retain at least one strap; and at least one fire-starting component configured to be used to ignite a fire, wherein the at least one fire-starting component comprises a striker moveably secured within a sheath on an outer portion of the at least one strap-retaining body, wherein the striker is configured to move in relation to the sheath.

16. The strapped article of claim 15, wherein the main body of material includes a pack to be worn on a back of the individual.

17. The strapped article of claim 15, wherein the at least one strap-retaining body of at least one of the plurality of strap-securing devices comprises a first buckle member, and a second buckle member configured to be removably connected to the first buckle member, and wherein the striker is secured to one of the first or second buckle members, and wherein the at least one fire-starting component further comprises at least one striker-engaging beam secured to at least one of the first or second buckle members, wherein the striker is configured to be swiped or scraped across the at least one striker-engaging beam to generate a spark to ignite the fire.

18. The strapped article of claim 17, wherein the at least one striker-engaging beam provides one or more of at least one strap bar for one or both of the first and second buckle members, or a guide beam configured to guide connection between the first and second buckle members, and wherein the at least one strap-retaining body of at least one of the plurality of strap-securing devices includes a compartment defining an internal chamber, wherein the compartment is outside of a connection interface that receives or is inserted into another strap-retaining body, and wherein the compartment is configured to store at least one item within the internal chamber, wherein the at least one fire-starting component comprises a plurality of fire-starting components, and wherein at least one of the plurality if fire-starting components is stored in the internal chamber.

19. A strap-securing device configured to be able to be used to ignite a fire, the strap-securing device comprising:

at least one strap-retaining body configured to retain at least one strap, wherein the at least one strap-retaining body includes a first buckle member, a second buckle member configured to be removably connected to the first buckle member, and a compartment defining an internal chamber, wherein the compartment is configured to store at least one item within the internal chamber; and at least one fire-starting component configured to be used to ignite a fire, wherein the at least one fire-starting component comprises a striker secured to one of the first or second buckle members, and at least one striker-engaging beam secured to at least one of the first or second buckle members, wherein the striker is configured to be swiped or scraped across the at least one striker-engaging beam to generate a spark to ignite the fire.

20. The strap-securing device of claim 19, wherein the at least one striker-engaging beam provides at least one strap bar for one or both of the first and second buckle members.

21. The strap-securing device of claim 19, wherein the at least one striker-engaging beam provides a guide beam configured to guide connection between the first and second buckle members.

22. The strap-securing device of claim 19, wherein the striker is moveably secured within a sheath on an outer portion of the first or second buckle member, wherein the striker is configured to move in relation to the sheath.

23. A strap-securing device configured to be able to be used to ignite a fire, the strap-securing device comprising:

at least one strap-retaining body configured to retain at least one strap, wherein the at least one strap-retaining body includes a slider and a compartment defining an internal chamber, wherein the compartment is configured to store at least one item within the internal chamber; and at least one fire-starting component configured to be used to ignite a fire.

24. The strap-securing device of claim 23, wherein the at least one fire-starting component includes at least one striker-engaging beam.

25. The strap-securing device of claim 24, wherein the at least one striker-engaging beam is removably clipped to the strap-retaining body.

26. The strap-securing device of claim 24, wherein the at least one striker-engaging beam provides at least one strap beam of the slider.

27. A strap-securing device configured to be able to be used to ignite a fire, the strap-securing device comprising:

at least one strap-retaining body configured to retain at least one strap, wherein the at least one strap-retaining body includes a cord lock and a compartment defining an internal chamber, wherein the compartment is configured to store at least one item within the internal chamber; and at least one fire-starting component configured to be used to ignite a fire.

28. A strap-securing device configured to be able to be used to ignite a fire, the strap-securing device comprising:

at least one strap-retaining body configured to retain at least one strap, wherein the at least one strap-retaining body includes a shackle and a compartment defining an internal chamber, wherein the compartment is configured to store at least one item within the internal chamber; and at least one fire-starting component configured to be used to ignite a fire.

* * * * *